United States Patent [19]

Nicol et al.

[11] Patent Number: 4,781,034

[45] Date of Patent: Nov. 1, 1988

[54] CRYOGENIC SUPPORT SYSTEM

[75] Inventors: Thomas H. Nicol, Aurora; Ralph C. Niemann, Downers Grove; John D. Gonczy, Oak Lawn, all of Ill.

[73] Assignee: Universities Research Association, Inc., Washington, D.C.

[21] Appl. No.: 60,682

[22] Filed: Jun. 10, 1987

[51] Int. Cl.[4] ..... F25B 19/00

[52] U.S. Cl. ..... 62/514 R; 62/297; 248/637

[58] Field of Search ..... 285/381; 29/447; 248/637; 62/514 R, 297

[56] References Cited

U.S. PATENT DOCUMENTS

| | | | |
|---|---|---|---|
| 4,074,412 | 2/1978 | Miskic | 29/447 |
| 4,325,530 | 4/1982 | Niemann et al. | 248/317 |
| 4,414,824 | 11/1983 | Durenec | 248/637 |
| 4,499,646 | 2/1985 | Allor et al. | 29/447 |
| 4,601,175 | 7/1986 | Kneip, Jr. et al. | 62/514 R |
| 4,672,202 | 6/1987 | Crossley, Jr. et al. | 62/514 R |

OTHER PUBLICATIONS

SSC Central Design Group, "Conceptual Design of the Superconducting Collider", Publication No. SSC-S-R-2020.

Nicol et al., 4/86, "A Suspension System for Superconducting Super Collider Magnets", 4/1986 International Cryogenic Engineering Conference.

Niemann et al., 5/86, "SSC Dipole Long Magnet Model Cryostat Design and Initial Production Experience", International Committee for Future Accelerators Workshop.

Niemann et al., 9/86, "Design, Construction and Test of a Full Scale SSC Dipole Magnet Cryostat Thermal Model, 1986 Applied Superconductivity Conf., Balt, Md.

Niemann et al., 11/86, "Superconduction Super Collider Magnet Cryostat", 6th Intersociety Cryogenic Symposium.

Nicol et al., 6/87 "SSC Magnet Cryostat Suspension System Design", 6/1987 Cryogenic Engineering Conference.

*Primary Examiner*—Ronald C. Capossela

*Attorney, Agent, or Firm*—Neuman, Williams, Anderson & Olson

[57] ABSTRACT

A support system is disclosed for restraining large masses at very low or cryogenic temperatures. The support system employs a tie bar that is pivotally connected at opposite ends to an anchoring support member and a sliding support member. The tie bar extends substantially parallel to the longitudinal axis of the cold mass assembly, and comprises a rod that lengthens when cooled and a pair of end attachments that contract when cooled. The rod and end attachments are sized so that when the tie bar is cooled to cryogenic temperature, the net change in tie bar length is approximately zero. Longitudinal force directed against the cold mass assembly is distributed by the tie bar between the anchoring support member and the sliding support member.

21 Claims, 4 Drawing Sheets

CRYOGENIC SUPPORT SYSTEM

This invention was made with Government support under Contract No. DE-AC02-76CH03000, awarded by the United States Department of Energy. The Government has certain rights in the invention.

FIELD OF THE INVENTION

This invention relates to an improved apparatus for supporting a cold mass assembly at cryogenic temperatures. More particularly, this invention relates to a cryogenic support apparatus which employs support posts linked by horizontal tie bars for distributing longitudinal force applied to the cold mass assembly. Each tie bar comprises a rod formed of a material that increases in length when cooled and end attachments that decrease in length when cooled.

BACKGROUND OF THE INVENTION

The design of devices that operate at very low temperatures including, for example, the proposed Superconducting Super Collider (SSC), has brought about the need for new solutions to the problem of providing adequate structural support to massive components operating at such low or cryogenic temperatures. The SSC is an advanced proton-proton collider for use in high energy physics research that will consist of two 30 kilometer diameter accelerator rings housed in a common tunnel. The rings will accelerate protons to energies up to 20 TeV prior to their collision in particle detection facilities. In order to achieve these energies, the rings will incorporate superconducting magnets to bend the proton beam (dipole magnets) and to focus the beam (quadrupole magnets). The superconducting magnets operate at cryogenic temperature, i.e., about 4.5K, and are encased in cryostats or vessels for maintaining a vacuum and constant low temperature. Approximately eight thousand cryostats will be connected end to end to form the SSC accelerator rings. The cryostats and their components must therefore not only be mechanically reliable, but must also be manufacturable at low cost.

The cryostats play a crucial role in the overall performance of the SSC and other similar devices operating at very low temperatures. The cryostats must minimize heat leak from the outside environment to the superconducting magnets in order to maintain the required cryogenic operating temperature. In fact, the ultimate operating cost of the SSC may depend principally upon the ability of the cryostats to prevent heat leak to the magnets.

The major components of the SSC cryostat are the cryogenic piping, cold mass assembly (which includes the magnets), thermal shields, insulation, vacuum vessel, the interconnections between cryostats, and the system for supporting or suspending the cold mass assembly. The support system must maintain the position of the cold mass assembly during shipping, installation, repeated cooldowns and warmups of the magnets, and seismic excitations. In addition, the support system must be positionally stable over the expected 20 year operating life of the SSC and exhibit high impedance to heat conducted from the outside environment. The support system must also be inexpensive to manufacture and assemble, as well as easy to install and adjust. Very similar concerns apply as well to other devices operating at low temperatures, regardless of the particular construction or tasks performed by such devices.

In each cryostat, the cold mass assembly is supported within the vacuum vessel at several discrete points by support members. The number and location of these support members is determined by the need to distribute the static and dynamic loads of the cold mass assembly among several support members. In general, the number of support members is minimized in order to minimize heat leak at the support locations and to facilitate the fabrication and assembly of the cryostats.

In the final design of the SSC cryostats, the support members are multi-section support posts. These support posts are fixed at their base to the vacuum vessel, which is in turn anchored to the tunnel floor. The cold mass assembly is then mounted on the support posts. The invention, however, is not limited to this particular post-type design of the support members.

The cold mass assembly is usually anchored at one point along its length, typically at its mid-length, to one of the support members. This anchoring member serves to restrain the cold mass assembly from movement in the longitudinal as well as the lateral and vertical directions. The cold mass assembly must be slidably supported, however, by each of the other support members in the cryostat to allow for the contraction and expansion of the cold mass assembly in the longitudinal direction in response to the extreme temperature variations within the cryostat such as during cooldown and warmup of the superconducting magnets. Anchoring the cold mass assembly at these other support locations would impose intolerable bending loads on the posts during longitudinal contraction and expansion of the cold mass assembly.

As a result of the anchoring of the cold mass assembly at only one point along its length, force directed against the cold mass assembly in the longitudinal direction, such as during shipping, installation and seismic excitations, will be entirely concentrated upon the one anchoring support member. Such a concentration of longitudinal force may subject the anchoring member to excessive bending load and have a detrimental effect on the structural integrity of the anchoring member, and in extreme instances, may cause the anchoring member to fail.

Efforts in the past to counteract the bending load on the anchoring member have been directed to reinforcing the anchoring member. In the case where the anchoring member is a post, one know solution is to fit the anchoring post with a pair of angled reinforcing struts. This approach is illustrated in several SSC publications, including SSC Central Design Group, "Conceptual Design of the Superconducting Super Collider", SSC-SR-2020 (March 1986) at page 156, and R. C. Niemann et al., "Design, Construction And Test Of A Full Scale SSC Dipole Magnet Cryostat Thermal Model", 1986 Applied Superconductivity Conference (1986) at FIG. 4.

Such reinforcing struts extend generally diagonally from pivoted connections on the base or lower end of the anchoring post to pivoted connections on the cold mass assembly. Upon the imposition of force on the cold mass assembly in the longitudinal direction, the angled struts contribute resistive strength, and prevent the concentration of force at the upper end of the anchoring post and consequent bending load. However, the struts suffer from the inherent disadvantage of having to penetrate the thermal shields and multilayer insulation surrounding the cold mass assembly in order to connect the cold mass assembly to the base of the anchoring post. Consequently, the use of angled reinforcing struts increases the chances of radiative heat leak to the cold mass assembly and also increases the cost of manufacturing the cryostats because of the need to form special openings in the thermal shields and insulate the regions where the struts penetrate the shields.

The present invention is directed to overcoming these and other difficulties inherent in the prior art. In the present invention, a cryogenic support system is provided which includes tie bars connecting the anchoring post to the adjacent support posts which slidably support the cold mass assembly. The tie bars are mounted substantially parallel to the longitudinal axis of the cold mass assembly, and hence there is no penetration of the thermal shields and insulation surrounding the cold mass assembly, and heat leak is thereby avoided. Each tie bar comprises a rod formed of a material having a negative coefficient of thermal expansion, and end attachments which have a positive coefficient of thermal expansion.

As used herein, the term "negative coefficient of thermal expansion" indicates that the material expands or lengthens as it is cooled, and contracts or shortens as it is warmed. Conversely, the term "positive coefficient of thermal expansion" indicates that the material contracts or shortens as it is cooled, and expands or lengthens as it is warmed.

Very few materials possess a negative coefficient of thermal expansion. One such material is graphite in fiber form, which lengthens upon cooling from ambient temperature to cryogenic temperature. However, forming a structural element, such as a rod, tube or bar, out of graphite fibers requires the use of binder material, such as epoxy, as a substrate for the graphite fibers. These binder materials, including epoxy, shrink when cooled from ambient temperature to cryogenic temperature.

In order to produce a graphite fiber material in which the lengthening of the fibers exceeds the shrinkage of the binder material, one must align the fibers in the same direction. Such an arrangement results in what is termed a "uniaxial" composition. It is desirable to incorporate as high a volume content of the fibers as possible in the composition because when the volume content of graphite fibers is too low, the thermal behavior of the binder material will dominate, and the composition will shrink when cooled. On the other hand, if the fiber content is too high, the fibers will not adhere properly.

We have found that a graphite reinforced plastic (GRP) composition with a fiber content of about 50–55% by volume, when subjected to the pultrusion process, will yield a uniaxial structural element that is reasonably stiff and that increases in length when cooled from ambient temperature to cryogenic temperature. The pultrusion process involves drawing or extruding the material through a series of successively smaller rings or orifices to produce a structural element (rod, tube or bar) having fibers oriented in the same direction. The precise increase in the length of the bar when it is cooled to cryogenic temperature will depend primarily upon the volume content of the fibers and the nature of the binder material. We have found, however, that uniaxial GRP tubular elements are sufficiently stiff for use as tie bars in the present invention, and exhibit the desired increase in length, i.e., about 0.01% to about 0.05%, when cooled from ambient temperature (about 300K) to cryogenic temperature (about 4.5K).

OBJECTS OF THE INVENTION

An object of the invention is to provide an improved low temperature support system to overcome the deficiences of prior art designs.

Another object of the invention is to provide a cryogenic support system for restraining a cold mass assembly in which force applied to the cold mass assembly in the longitudinal direction is distributed and shared among the posts supporting the cold mass assembly.

Yet another object of the invention to provide a cryogenic support system that includes support posts connected by tie bars which do not penetrate the thermal shields and insulation surrounding the cold mass assembly.

A further object of the invention is to provide a tie bar for connecting cryogenic support posts wherein the tie bar does not exhibit a significant change in length upon cooling from ambient temperature to very low and/or cryogenic temperature and vice versa.

SUMMARY OF THE INVENTION

These and other objects are achieved by an improved cryogenic support apparatus for supporting a cold mass assembly having a longitudinal axis. The apparatus comprises an anchoring support member rigidly affixed at one end to a foundation and rigidly affixed at its other end to the cold mass assembly. A sliding support member is spaced longitudinally from the anchoring support member. The sliding support member is rigidly affixed at its lower end to a foundation and, at its upper end, slidably supports the cold mass assembly so as to permit movement of the cold mass assembly in the longitudinal direction but restrict movement of the cold mass assembly in the lateral direction. A tie bar is pivotally connected at one end to the anchoring support member and at the other end to the sliding support member. The tie bar is thus disposed substantially parallel to the longitudinal axis of the cold mass assembly. The tie bar comprises a rod having a negative coefficient of the thermal expansion and a pair of end attachments having a positive coefficient of thermal expansion. Force directed to the cold mass assembly in the longitudinal direction is distributed by the tie bar between the anchoring support member and the sliding support member.

In the preferred embodiment of the invention, the rod component of the tie bar is tubular and formed of a uniaxial graphite reinforced plastic composition. The end attachments are stainless steel. Upon cooling from ambient temperature to cryogenic temperature, the length of the uniaxial GRP rod increases because of its negative coefficient of thermal expansion, while the stainless steel end attachments contract. The rod and end attachments are sized so as to produce a net change in length for the tie bar of approximately zero when the tie bar is cooled from to cryogenic temperature. As a result, the tie bars themselves do not impose bending loads upon the support posts during cooldown and warmup.

The support system of the present invention has applications beyond those specifically described below for the SSC. Generally speaking, the present support system will be useful in applications that require a large mass to be supported and restrained in an environment subject to large temperature fluctuations. Examples of such applications include low temperature magnets for industrial and medical uses, dewars for storing liquified gases at low temperatures, and over-the-road trailers for transporting low temperature materials.

DETAILED DESCRIPTION OF THE PREFERRED EMBODIMENT

Figure 1:
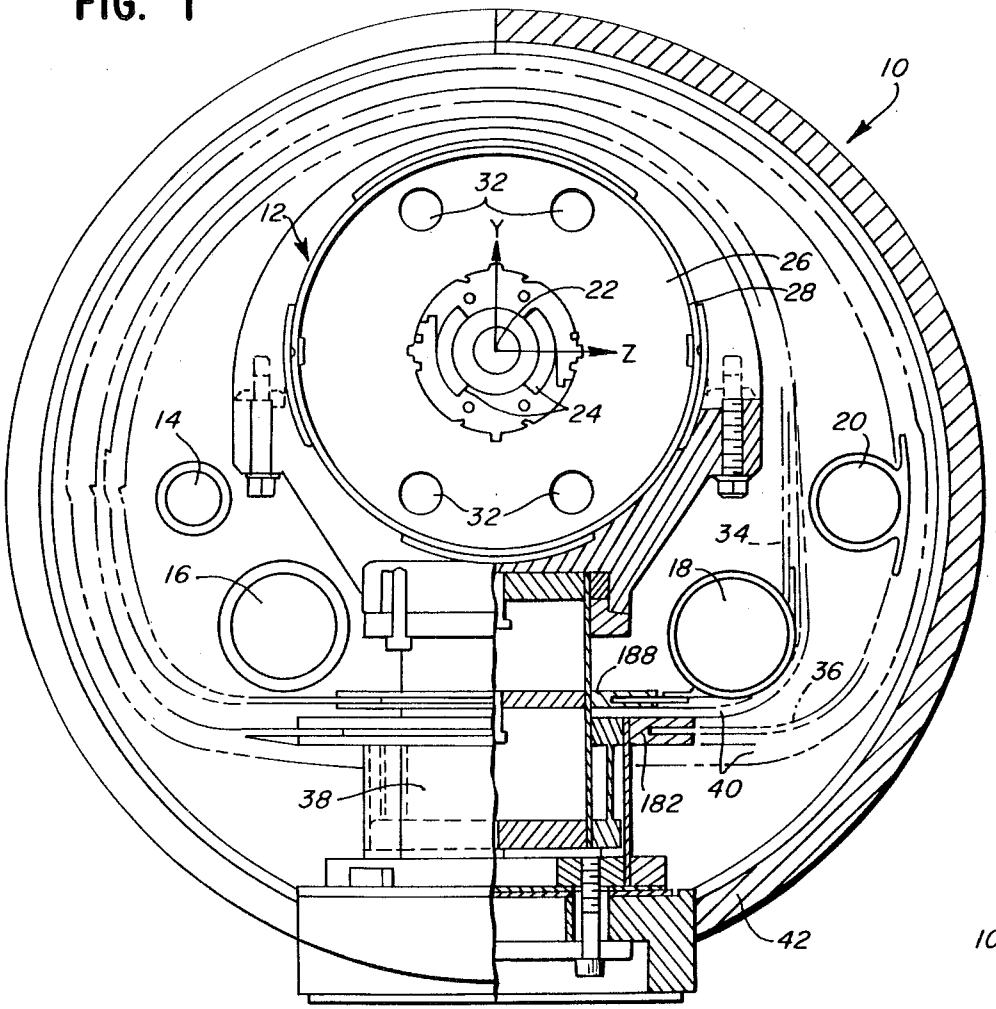
FIG. 1 is a cross-sectional view of an SSC cryostat, particularly illustrating the cryogenic piping, cold mass assembly, thermal shields, insulation, support post and vacuum vessel.

Turning first to FIG. 1 of the drawings, a typical cryostat 10 to be used in the SSC is shown with its associated cryostat elements. The major elements of cryostat 10 are the cryogenic piping, cold mass assembly, thermal shields, insulation, support system, vacuum vessel and interconnections between cryostats (not shown).

The cryogenic piping forms the SSC magnet refrigeration system. The piping includes the cold mass assembly 12, which contains the 4.35K helium coolant channels 32. The cryostat piping also includes the 4.35K helium liquid return pipe 14, the 4.35K helium gas return pipe 16, the 20K helium thermal shield cooling pipe 18, and 80K liquid nitrogen thermal shield cooling pipe 20.

In addition to helium coolant channels 32, cold mass assembly 12 includes beam tube 22, superconducting magnet coils 24, iron yoke 26, and outer helium containment shell 28. Iron yoke 26 consists of a series of iron laminations or panels stacked along the length of the cryostat. The cold mass assembly components are joined together to provide a leak-tight and structurally rigid welded assembly. Outer shell 28 is the principal structural element of cold mass assembly 12 and provides the required flexural rigidity between the support posts. The total length of cold mass assembly 12 is approximately 55 feet and its total weight is approximately 16,000 pounds.

As shown in FIG. 1, thermal shields 34 and 36 surround cold mass assembly 12 and are designed to prevent radiative heat leak to the cold mass assembly. Thermal shields 34 and 36 are maintained at 20K and 80K, respectively. Shields 34 and 36 are preferably constructed of aluminum, and are supported by and thermally anchored to the metallic rings 188 and 182, respectively, of support post 38. Insulation 40 is installed on the radially outward surfaces of thermal shields 34 and 36.

Cold mass assembly 12 and thermal shields 34 and 36 are supported relative to the vacuum vessel by the support system, one component of which is illustrated in FIG. 1 as support post 38. In the illustrated embodiment, support post 38 is rigidly affixed at its lower end to vacuum vessel 42. Vacuum vessel 42, shown in FIG. 1, forms the outer shell of cryostat 10, and defines the insulating vacuum space within cryostat 10. A separate vacuum mechanism (not shown) maintains a vacuum pressure of approximately $10^{-6}$ torr within cryostat 10 during operation of the magnets. Vacuum vessel 4 is fabricated from steel pipe and is rigidly mounted by support feet (not shown) to the tunnel floor. The present invention is, of course, not limited to the particular design of cryostat 10.

Figure 2:
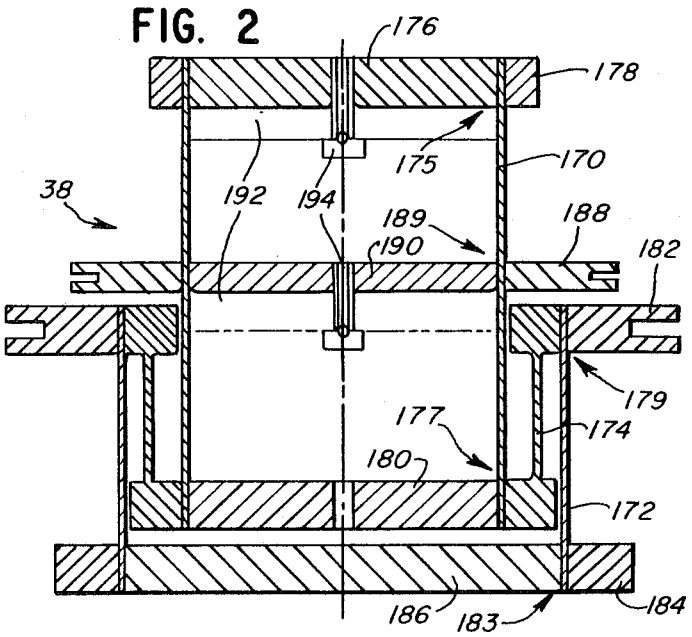
FIG. 2 is a sectional view of a multi-section support post on which the cold mass assembly is mounted.

Turning now to FIG. 2, multi-section support post 38 is described in copending application Ser. No. 863,492 filed May 15, 1986, now U.S. Pat. No. 4,696,169, incorporated herein by reference in its entirety. Support post 38 is constructed of fiber reinforced plastic (FRP) and/or graphite reinforced plastic (GRP) tubular elements with metallic interconnections and heat intercepts. The junctions between the tubular elements and the metallic interconnections transmit tension, compression, bending and torsional loads imposed by the cold mass assembly. The junctions are formed by fitting a metallic ring or sleeve over the FRP or GRP tube and then shrink-fitting a central metallic plug or disc inside the tube at the location of the sleeve. Support post 38 resists its primary load (the cold mass assembly) through the compressive loading of the tubular elements.

Support post 38 comprises first GRP tube 170 coupled to second FRP tube 172 by metallic cylinder 174. A first interconnection 175 is formed by shrink-fitting metallic disc 176 and metallic ring 178 to the upper end of GRP tube 170. The lower end of RP tube 170 is disposed within metallic cylinder 174. A second interconnection 177 is formed by shrink-fitting metallic disc 180 and metallic cylinder 174 to the lower end of GRP tube 170.

As further shown in FIG. 2, a third interconnection 179 is formed by shrink-fitting metallic cylinder 174 and metallic ring 182 to the upper end of FRP tube 172. Metallic ring 182 also serves as a support member for thermal shield 36 (not shown FIG. 2). A fourth interconnection 183 is formed by shrink fitting metallic disc 186 and metallic ring 184 to the lower end of FRP tube 172. A fifth interconnection 189 is formed by shrink-fitting metallic disc 190 and metallic ring 188 to the mid-section of GRP tube 170. Metallic ring 188 also serves as a support member for thermal shield 34 (not shown in FIG. 2). Multilayer insulation 192 is fastened to the undersides of metallic discs 176 and 190 by bolts 194 in order to prevent heat leakage through support post 38.

While the design of support post 38 illustrated in FIG. 2 is preferred, those skilled in the art will recognize that other support member designs can be employed in practicing the present invention. An example of one such alternate design is a system employing a series of tension members for suspending the cold mass assembly from the ceiling of the vacuum vessel.

Figure 3:
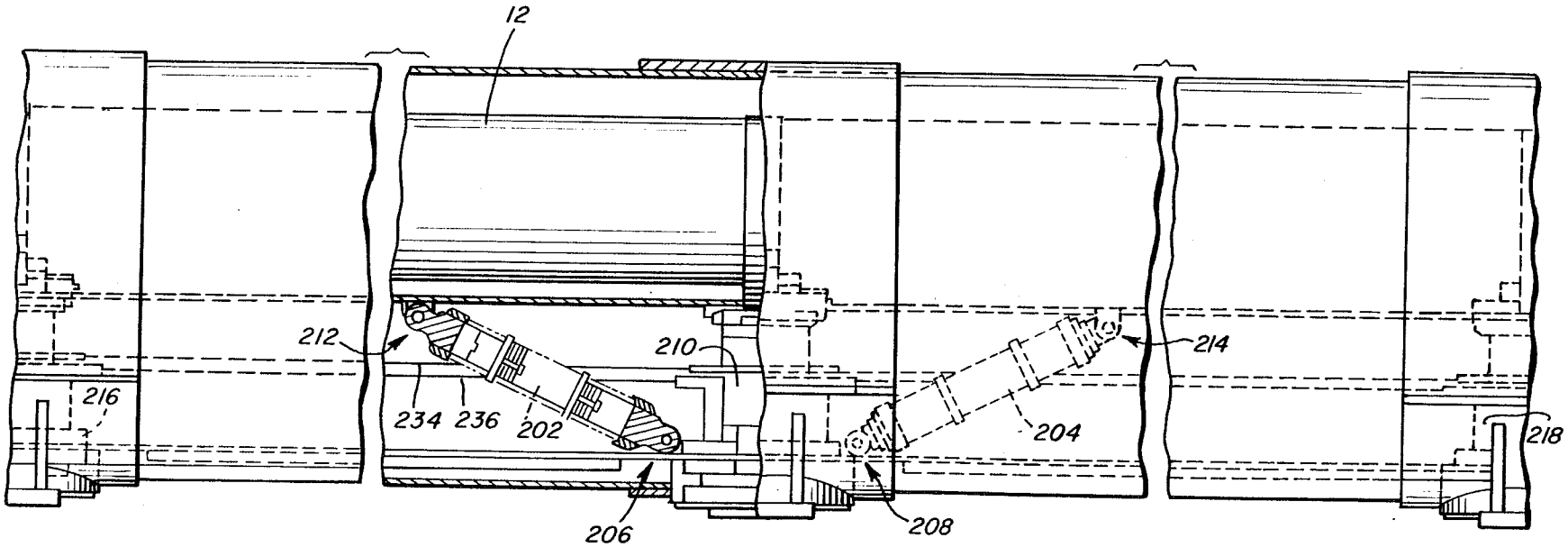
FIG. 3 (PRIOR ART)
FIG. 3 is a side view, partly in section, of a prior art support system for restraining a cold mass assembly, particularly illustrating the use of angled reinforcing struts at the anchoring post.

Turning now to FIG. 3, the prior art solution of reinforcing the anchoring post with angled reinforcing struts is illustrated. As shown, reinforcing struts 202 and 204 extend diagonally from pivoted connections 206 and 208, respectively, on the base of anchoring support post 210. Anchoring support post 210 is rigidly affixed at its upper end to cold mass assembly 12; support posts 216 and 218 slidably support cold mass assembly 12. Reinforcing struts 202 and 204 are pivotally connected to cold mass assembly 12 at pivoted connections 212 and 214, respectively. As shown in FIG. 3, reinforcing struts 202 and 204 penetrate thermal shields 234 and 236 in order to connect the cold mass assembly 12 to the base of anchoring post 210. As a result, the employment of reinforcing struts 202 and 204 increases the chances of radiative heat leak to cold mass assembly 12. The use of reinforcing struts 202 and 204 also increases the manufacturing cost because of the need to form special openings in thermal shields 234 and 236 and insulate the regions where struts 202 and 204 penetrate the thermal shields.

Figure 4:
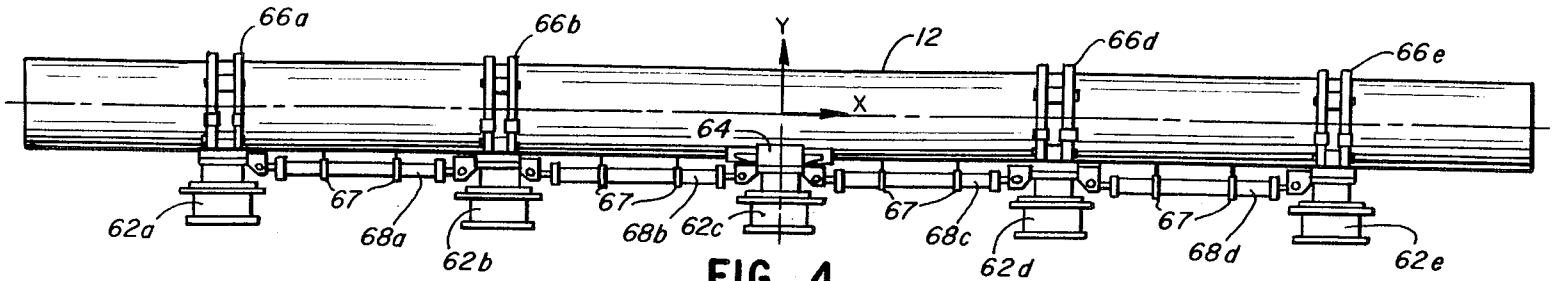
FIG. 4 is a side view of one embodiment of the support system for the cold mass assembly, showing a mid-length anchoring post, four sliding posts, and tie bars interconnecting the support posts.

An example of the improved support system for restraining cold mass assembly 12 at very low temperatures is illustrated in FIG. 4. The support system employs five support posts 62*a*, 62*b*, 62*c*, 62*d* and 62*e* which are rigidly affixed at their lower ends to the vacuum vessel (not shown) by welded means, chemically bonded means, bolts or the like. As shown in FIG. 4, outermost support posts 62*a* and 62*e* are located toward the ends of cold mass assembly 12. Support post 62*c* is located at the mid-length of cold mass assembly 12. Support posts 62*b* and 62*d* are located at intermediate positions between mid-length support post 62*c* and outermost support posts 62*a* and 62*e*, respectively.

In the preferred embodiment, mid-length support post 62*c* is fitted on its upper and with a cradle 64. Cradle 64 is rigidly affixed to the upper end of post 62*c*, preferably by bolts, but welded means, chemical adhesives and the like may also be employed. As shown in FIG. 4, cold mass assembly 12 is mounted in cradle 64, and a rigid connection is formed between cradle 64 and cold mass assembly 12, preferably by welding. Because of the rigid fastening of cold mass assembly 12 to cradle 64, cradle 64 is also referred to as the "fixed cradle". Similarly, mid-length support post 62*c* is referred to as the "anchoring post".

The metallic composition of cold mass assembly 12 will cause it to contract longitudinally upon cooling from ambient temperature (approximately 300K) to cryogenic temperature (approximately 4.5K). Cold mass assembly 12 may also contract radially upon cooling, but such radial contraction is generally negligible in comparison to the longitudinal contraction. As a result of such longitudinal contraction, the ends of cold mass assembly 12 will contract toward anchoring post 62*c* upon cooling, as illustrated by the arrows "A" in FIG. 4. In this regard, it has been found that the end-to-center distance of the 55 foot cryostat described herein decreases approximately 1.0 inch upon cooling from ambient to cryogenic temperature. Conversely, upon warmup from cryogenic temperature to ambient temperature, the end-to-center distance of cold mass assembly 12 will increase approximately 1.0 inches in the longitudinal direction away from anchoring post 62*c*.

Because of the need to allow for the significant longitudinal contraction and expansion of cold mass assembly 12 during magnet cooldown and warmup, the rigid connection employed at anchoring post 62*c* cannot be employed at the other support posts 62*a*, 62*b*, 62*d* and 62*e*. Such rigid anchoring would create intolerable bending loads upon support posts 62*a*, 62*b*, 62*d* and 62*e* during magnet cooldown and warmup. Support posts 62*a*, 62*b*, 62*d* and 62*e* are therefore equipped with collars or slide cradles 66*a*, 66*b*, 66*d* and 66*e*, which permit cold mass assembly 12 to move in the longitudinal direction, but restrain movement of cold mass assembly 12 in the lateral and vertical directions. If the mass of cold mass assembly 12 is sufficiently large, it may not be necessary to physically restrain cold mass assembly 12 in the vertical direction because of gravity.

Support posts 62*a*, 62*b*, 62*d* and 62*e* are also referred to as the "sliding posts" because of the longitudinal movement of cold mass assembly 12 in the slide cradles mounted on sliding posts. It should be noted, however, that the sliding posts do not actually slide themselves, but are anchored at their lower ends to the vacuum vessel (not shown in FIG. 4).

The arrow designated by the letter "X" in FIG. 4 represents the longitudinal direction; the arrow designated by the letter "Y" represents the vertical direction. The lateral direction is normal to the plane of FIG. 4. The lateral and vertical directions are also shown in FIG. 1, represented by the arrows designated "Z" and "Y", respectively.

FIG. 4 also shows the linking of the five support posts by four tie bars 68*a*, 68*b*, 68*c* and 68*d*. First outer tie bar 68*a*, left-most in FIG. 4, is pivotally connected at one end to sliding post 62*a* and at the other end to sliding post 62*b*. Similarly, first inner tie bar 68*b* is pivotally connected at one end to sliding post 62*b* and at the other end to anchoring post 62*c*. Second inner tie bar 68*c* is pivotally connected at one end to anchoring post 62*c* and at the other end to sliding post 62*d*. Finally, second outer tie bar 68*d* is pivotally connected at one end to sliding post 62*d* and at the other end to sliding post 62*e*. Depending upon the length of the rod component of the tie bars, it may be necessary to employ guides or collars 67 at one or more points along the length of the tie bars to prevent buckling during compression of the tie bars.

Figure 5:
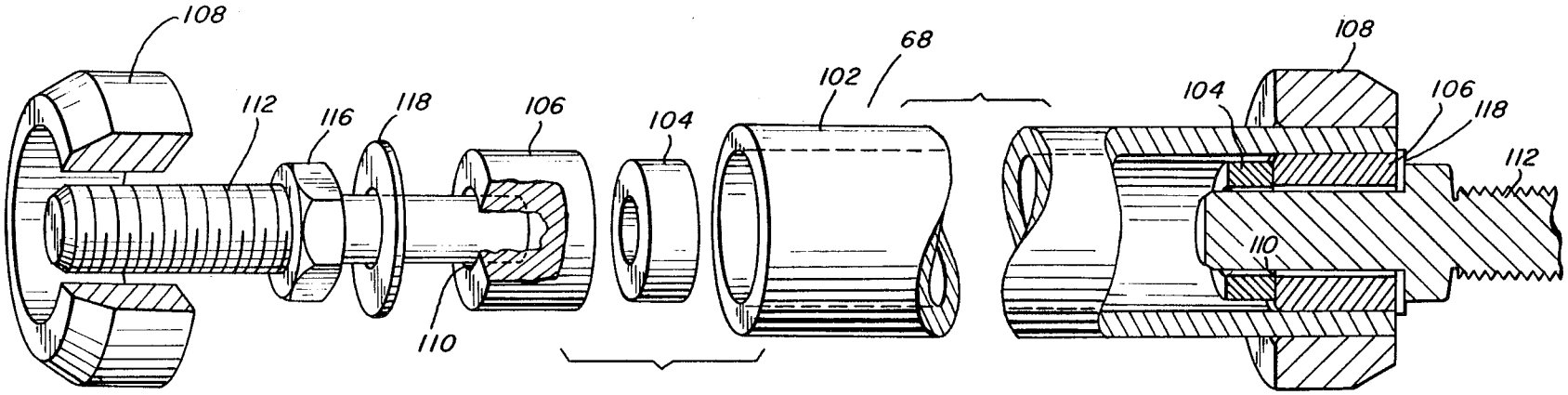
FIG. 5 is a partially exploded perspective view of the tie bar of the present invention, particularly illustrating the rod and end attachment components.

Turning to FIG. 5, a the bar 68 is shown with its associated components. Rod 102 is formed of a material having a negative coefficient of thermal expansion, and is preferably a uniaxial graphite reinforced plastic tube. Rod 102 may also be polygonal in cross section, such as octagonal.

As further shown in FIG. 5, a pair of end attachments is secured to opposite ends of rod 102. In the preferred embodiment, the components of each end attachment are metallic, especially preferably stainless steel, and consist of outer ring 108, disc 106, partially threaded member 112, washer 118, and retaining ring 104. Partially threaded member 112 has an integral adjusting hex 116. The unthreaded portion of member 112 is inserted through washer 118 into bore 110 formed in disc 106. The diameter of bore 110 is slightly greater than the diameter of the unthreaded portion of member 112. After insertion of member 112 into bore 110, retaining ring 104 is welded to member 112 so as to permit member 112 to rotate freely within bore 110. An end attachment is shown in assembled form at the right-hand side of FIG. 5.

The end attachments may be fastened to rod 102 by chemical adhesives, bolts, pins and the like. The preferred fastening means, when rod 102 is tubular, is to shrink-fit the end attachments onto opposite ends of tube 102. To accomplish this, disc 106 has an outer diameter slightly greater than the inner diameter of tube 102 when both are at ambient temperature. When disc 106 is cooled to cryogenic temperature and tube 102 is maintained at ambient temperature, the outer diameter of disc 106 is less than the inner diameter of tube 102.

Outer ring 108 has an inner diameter which is slightly greater than the outer diameter of tube 102 when both are at ambient temperature. The tolerances between the inner diameter of outer ring 108 and the outer diameter of tube 102 are preferably such that a slide fit is formed between the two surfaces at ambient temperature. Shrink-fitting is accomplished by sliding ring 108 over tube 102 at ambient temperature and then cooling disc 106 to a cryogenic temperature such that its diameter is less than the inner diameter of tube 102. Disc 106 is then inserted into tube 102 which is at ambient temperature. Disc 106 is allowed to equilibrate to ambient temperature, thereby expanding. Upon expansion of disc 106, tube 102 will be clamped between disc 106 and outer ring 108.

The relative lengths of rod 102 and the end attachment components are determined by their respective thermal properties so as to produce a net change in length of approximately zero when the bar is cooled to cryogenic temperature. For example, if rod 102 exhibits an increase in length of 0.03 percent upon cooling from ambient temperature to cryogenic temperature, and each end attachment exhibits a corresponding decrease in length of 0.3 percent, then the length of rod 102 should be about 20 times the length of each end attachment to produce a zero net change in length for the tie bar (rod plus two end attachments). It will be appreciated by those skilled in the art that the net change in the length of the tie bar when cooled from ambient temperature to cryogenic temperature need not be precisely zero because the support posts can withstand limited bending loads. It is important, however, that the net change in tie bar length be as close to zero as possible so as to avoid placing any more than an incidental amount of bending load upon the support posts.

Figure 6:
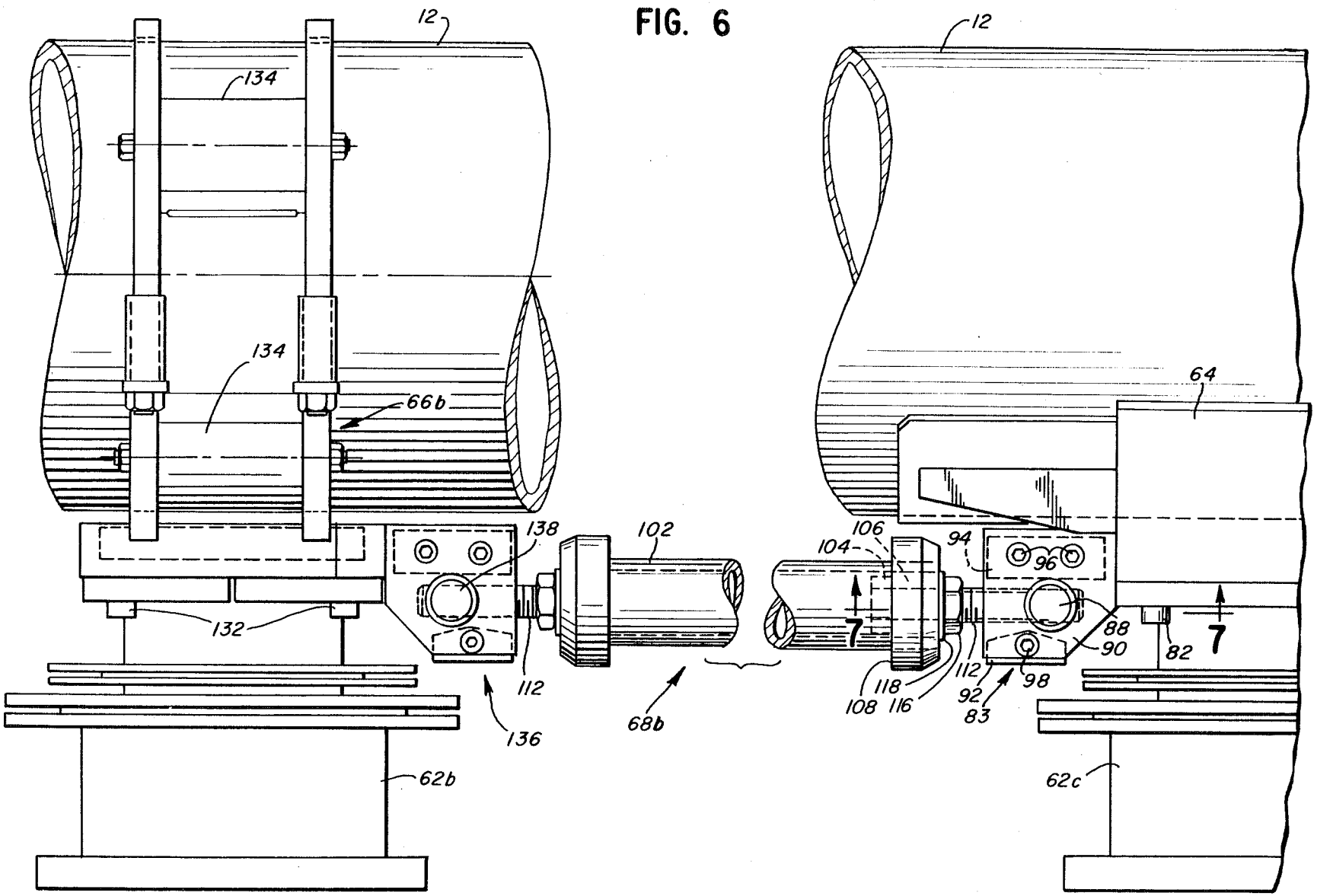
FIG. 6 is a side view of a portion of the cryogenic support system showing the mounting of the cold mass assembly on the anchoring post and on an adjacent sliding post, and also showing a tie bar pivotally connected to the anchoring post and to the sliding post.

The preferred connection of the tie bar to the support posts is illustrated in FIG. 6. It will be appreciated, of course, that the present invention is not limited to this particular type of pivotal connection.

As shown in FIG. 6, fixed cradle 64 is mounted on the upper end of anchoring post **62*c* by means of bolts, one of which is illustrated as bolt 82. Cold mass assembly 12 is mounted on and rigidly affixed to fixed cradle 64. The pivotal connection between tie bar 68*b* and fixed cradle 64 is provided by pin joint assembly 83. As shown more particularly in FIG. 7, pin joint assembly 83 consists of side plates 84 and 90, spacer blocks 92 and 94, bolts 96 and 98, and cylindrical pin 88. Side plate 84 is welded to fixed cradle 64. One end of cylindrical pin 88 is carried in a circular bore formed in side plate 84. The other end of cylindrical pin 88 is carried in a corresponding circular bore formed in side plate 90. Side plate 90 is disposed substantially parallel to plate 84 and is spaced apart from plate 84 by means of spacer blocks 92 and 94. Bolts 96 project through holes in side plate 90 and spacer bar 94 into threaded receptacles in side plate 84. Similarly, bolt 98 projects through holes in side plate 90 and spacer bar 92 into a threaded receptacle in plate 84**.

Figure 7:
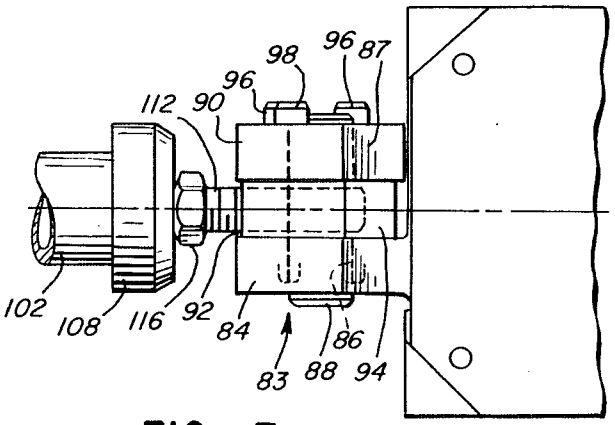
FIG. 7 is a bottom plan view taken in the direction of line 6—6 of FIG. 6, particularly illustrating the pivotal connection between the tie bar and the anchoring post.

As shown in FIGS. 6 and 7, the outwardly projecting threaded portion of member 112 is inserted into a threaded hole formed at the mid-length of cylindrical pin 88. Tie bar **68*b* can thus be drawn toward or away from cylindrical pin 88 by rotating integral hex 116**.

Referring to the left hand portion of FIG. 6, slide cradle **66*b* is shown mounted on support post 62*b* by bolts, two of which are illustrated as bolts 132. Slide cradle 66*b* forms a collar around cold mass assembly 12 so as to permit cold mass assembly 12 to move in the longitudinal direction, shown in FIG. 6 by double headed arrow "X". Slide cradle 66*b* restrains cold mass assembly 12 from movement in either the vertical or lateral directions. Slide cradle 66*b* is fitted with a plurality of bearing pads, two of which are illustrated in FIG. 6, as bearing pads 134. The inner surface of each bearing pad 134 contacts cold mass assembly 12** and is provided with a dry lubricated material, preferably a self lubricating bearing material such as teflon- and lead-impregnated bronze on a steel backing, such as the bearing material manufactured by Garlock Bearings, Inc. under the tradename DU.

As further shown in the left-hand portion of Fig. 6, a pin joint assembly 136, identical in construction to pin joint assembly 83, is rigidly attached to slide cradle **66*b*, preferably by welding. Pin joint assembly 136 carries a cylindrical pin 138 (identical to cylindrical pin 88), which has a threaded hole formed at its mid-length. The threaded portion of member 112 projecting outwardly from the left-hand end of tie bar 68*b* in FIG. 6 is inserted into the threaded hole in cylindrical pin 138 to form the pivotal connection between tie bar 68*b* and slide cradle 66*b***.

In operation, the tie bars of the preferred embodiment distribute longitudinal force applied to the cold mass assembly among all five support posts. Referring to FIG. 4, force applied longitudinally to cold mass assembly 12 will first act on fixed cradle 64 and corresponding anchoring post **62*c*. The bending load placed upon fixed cradle 64 and anchoring post 62*c* will be distributed by tie bars 68*b* and 68*c* among intermediate support posts 62*b* and 62*d*, respectively. Depending upon the direction of the longitudinal force acting upon cold mass assembly 12, one of tie bars 62*b* and 68*c* will be in tension; the other will be in compression. The bending load imposed upon intermediate support posts 62*b* and 62*d* will be distributed in turn by tie bars 68*a* and 68*d* among outermost support posts 62*a* and 62*e*, respectively. Again, depending upon the direction of the longitudinal force acting upon cold mass assembly 12, one of tie bars 68*a* and 68*d*** will be in tension, the other will be in compression.

Because the tie bars are mounted substantially parallel to the longitudinal axis of the cold mass assembly, there is no penetration of the thermal shields or insulation surrounding the cold mass assembly. Moreover, the use in each tie bar of materials having counteracting thermal expansion properties results in substantially no net change in tie bar length as the cold mass assembly is cooled from ambient temperature to cryogenic temperature and vice versa.

While particular elements and applications of the present invention have been shown, it will be understood, of course, that the invention is not limited thereto since modifications may be made by those skilled in the art, particularly in light of the foregoing teachings. It is, therefore, contemplated by the appended claims to cover any such modifications as incorporate those feature which come within the true spirit and scope of the invention.

What is claimed is:

1. A cryogenic support system for restraining a cold mass assembly having a longitudinal axis, comprising:

an anchoring support member rigidly affixed at one end to a foundation and at the other end to the cold mass assembly;

a sliding support member spaced longitudinally from said anchoring support member, said sliding support member rigidly affixed at one end to a foundation and slidably supporting the cold mass assembly at the other end so as to permit longitudinal movement of the cold mass assembly but restrict lateral movement of the cold mass assembly;

a tie bar pivotally connected at one end to said anchoring support member and at the other end to said sliding support member, said tie bar disposed substantially parallel to the longitudinal axis of the cold mass assembly;

said tie bar comprising a rod having a negative coefficient of thermal expansion and a pair of end attachments affixed to opposite ends of said rod, each of said end attachments having a positive coefficient of thermal expansion;

whereby force directed along the longitudinal axis of the cold mass assembly is distributed by said tie bar between said anchoring support member and said sliding support member.

2. The cryogenic support apparatus of claim 1 wherein the composition of said rod is uniaxial graphite reinforced plastic.

3. The cryogenic support apparatus of claim 2 wherein the fiber content of said uniaxial graphite reinforced plastic composition is about 50–55 percent by volume.

4. The cryogenic support apparatus of claim 2 wherein said rod is tubular.

5. The cryogenic support apparatus of claim 1 wherein said end attachments are metallic.

6. The cryogenic support apparatus of claim 5 wherein said end attachments are formed of stainless steel.

7. A cryogenic support apparatus for restraining a cold mass assembly having a longitudinal axis, comprising:

an anchoring post rigidly affixed at its lower end to a foundation, and rigidly affixed at its upper end to the cold mass assembly, a sliding post spaced longitudinally from said anchoring post, said sliding post rigidly affixed at its lower end to a foundation and slidably supporting the cold mass assembly at its upper end so as to permit longitudinal movement of the cold mass assembly but restrict lateral movement of the cold mass assembly;

a tie bar pivotally connected at one end to said upper end of said anchoring post and pivotally connected at its other end to said upper end of said sliding post, said tie bar disposed substantially parallel to the longitudinal axis of the cold mass assembly;

said tie bar comprising a rod having a negative coefficient of thermal expansion and a pair of end attachments affixed to opposite ends of said rod, each of said end attachments having a positive coefficient of thermal expansion;

whereby force directed along the longitudinal axis of the cold mass assembly is distributed by said tie bar between said anchoring post and said sliding post.

8. The cryogenic support apparatus of claim 7 wherein the composition of said rod is uniaxial graphite reinforced plastic.

9. The cryogenic support apparatus of claim 8 wherein the fiber content of said uniaxial graphite reinforced plastic rod is about 50–55 percent by volume.

10. The cryogenic support apparatus of claim 8 wherein said rod is tubular.

11. The cryogenic support apparatus of claim 7 wherein said end attachments are metallic.

12. The cryogenic support apparatus of claim 11 wherein said end attachments are stainless steel.

13. The cryogenic support apparatus of claim 7 wherein said anchoring post includes a fixed cradle mounted on the upper end thereof, said fixed cradle rigidly affixed to the cold mass assembly, and wherein said sliding post includes a slide cradle mounted on the upper end thereof, said slide cradle slidably supporting the cold mass assembly so as to permit longitudinal movement of the cold mass assembly but restrict lateral movement of the cold mass assembly.

14. A cryogenic support apparatus for restraining a cold mass assembly having a longitudinal axis, comprising:

a plurality of longitudinally spaced support posts, each of said support posts rigidly affixed at its lower end to a foundation;

one of said support posts rigidly affixed at its upper end to the cold mass assembly;

the others of said support posts slidably supporting the cold mass assembly so as to permit longitudinal movement of the cold mass assembly but restrict lateral movement of the cold mass assembly;

a plurality of tie bars connecting said support posts, each of said tie bars pivotally connected at opposite ends thereof to adjacent support posts, said tie bars disposed substantially parallel to the longitudinal axis of the cold mass assembly;

each of said tie bars comprising a rod having a negative coefficient of thermal expansion and a pair of end attachments affixed to opposite ends of said rod, each of said end attachments having a positive coefficient of thermal expansion;

whereby force directed along the longitudinal axis of the cold mass assembly is distributed by said tie bars among said support posts.

15. The cryogenic support apparatus of claim 14 wherein the composition of said rod is uniaxial graphite reinforced plastic.

16. The cryogenic support apparatus of claim 15 wherein the fiber content of said uniaxial graphite reinforced plastic composition is about 50–55 percent by weight.

17. The cryogenic support apparatus of claim 15 wherein said rod is tubular.

18. The cryogenic support apparatus of claim 14 wherein said end attachments are metallic.

19. The cryogenic support apparatus of claim 18 wherein said end attachments are formed of stainless steel.

20. In a cryogenic support apparatus for restraining a cold mass assembly having a longitudinal axis, wherein an anchoring post is rigidly affixed at its lower end to a foundation and rigidly affixed at its upper end to the cold mass assembly, and wherein a sliding post is rigidly affixed at its lower end to a foundation and slidably supports the cold mass assembly at its upper end so as to permit longitudinal movement of the cold mass assembly but restrict lateral movement of the cold mass assembly, the improvement which comprises:

a tie oar pivotally connected at one end to the upper end of said anchoring post and pivotally connected at its other end to the upper end of said sliding post, said tie bar disposed substantially parallel to the longitudinal axis of the cold mass assembly;

said tie bar comprising a rod having a negative coefficient of thermal expansion and a pair of end attachments affixed to opposite ends of said rod, each of said end attachments having a positive coefficient of thermal expansion;

whereby force directed along the longitudinal axis of the cold mass assembly is distributed by said tie bar between said anchoring post and said sliding post.

21. In a cryogenic support apparatus for restraining a cold mass assembly having a longitudinal axis, wherein each of a plurality of longitudinally spaced support posts is rigidly affixed at its lower end to a foundation, and wherein one of said support posts is rigidly affixed at its upper end to the cold mass assembly, and wherein the others of said support posts slidably support the cold mass assembly so as to permit longitudinal movement of the cold mass assembly but restrict lateral movement of the cold mass assembly, the improvement which comprises:

a plurality of tie bars connecting the support posts, each of said tie bars pivotally connected at opposite ends to adjacent support posts, said tie bars disposed substantially parallel to the longitudinal axis of the cold mass assembly;

each of said tie bars comprising a rod having a negative coefficient of thermal expansion and a pair of end attachments affixed to opposite ends of said rod, each of said end attachments having a positive coefficient of thermal expansion;

whereby force directed along the longitudinal axis of the cold mass assembly is distributed by said tie bars among said support posts.

* * * * *